US010077521B2

(12) United States Patent
Kawamura et al.

(10) Patent No.: US 10,077,521 B2
(45) Date of Patent: Sep. 18, 2018

(54) WASHING MACHINE

(71) Applicants: HAIER ASIA INTERNATIONAL CO., LTD., Osaka (JP); QINGDAO HAIER WASHING MACHINE CO., LTD., Shandong (CN)

(72) Inventors: Tamotsu Kawamura, Osaka (JP); Tomohiro Yamauchi, Osaka (JP)

(73) Assignees: HAIER ASIA INTERNATIONAL CO., LTD., Osaka (JP); QINGDAO HAIER WASHING MACHINE CO., LTD., Shandong (CN)

( * ) Notice: Subject to any disclaimer, the term of this patent is extended or adjusted under 35 U.S.C. 154(b) by 0 days.

(21) Appl. No.: 15/317,040

(22) PCT Filed: Dec. 31, 2014

(86) PCT No.: PCT/CN2014/095888

§ 371 (c)(1),
(2) Date: Dec. 7, 2016

(87) PCT Pub. No.: WO2015/192639

PCT Pub. Date: Dec. 23, 2015

(65) Prior Publication Data

US 2017/0096759 A1 Apr. 6, 2017

(30) Foreign Application Priority Data

Jun. 16, 2014 (JP) ..... 2014-123338

(51) Int. Cl.
*D06F 23/06* (2006.01)
*D06F 17/06* (2006.01)

(52) U.S. Cl.
CPC ..... *D06F 23/06* (2013.01); *D06F 17/06* (2013.01)

(58) Field of Classification Search
CPC combination set(s) only.
See application file for complete search history.

(56) References Cited

U.S. PATENT DOCUMENTS 5,727,403 A * 3/1998 Na ..... D06F 17/08 68/133

FOREIGN PATENT DOCUMENTS

CN 2333728 Y * 8/1999 ..... D06F 17/10
CN 2333728 Y 8/1999
(Continued)

OTHER PUBLICATIONS

PCT International Search Report dated Mar. 27, 2015 from corresponding Application No. PCT/CN2014/095888.

*Primary Examiner* — Alexander Markoff
*Assistant Examiner* — Cristi J Tate-Sims
(74) *Attorney, Agent, or Firm* — Dilworth IP, LLC

(57) ABSTRACT

A washing machine capable of reducing power consumption comprising: a substantially bottomed cylindrical washing tank; a rotary wing rotatably and freely arranged at a bottom of the washing tank; and a driving unit for rotatably driving the rotary wing by being powered by electricity. The rotary wing is formed in a disc shape and centered on a rotary axis (Ra), and a plurality of stirring blades radially extending towards an outer circumference are arranged on a surface of the rotary wing. A center (Cw) of these stirring blades is set at a position more misplaced towards an outer diameter direction than the rotary axis (Ra), and a protrusion part more protruded towards an axial direction of the rotary axis (Ra) than the stirring blades is arranged at the center (Cw) of the plurality of stirring blades.

6 Claims, 12 Drawing Sheets

(56) References Cited

FOREIGN PATENT DOCUMENTS

| | | | | | |
|---|---|---|---|---|---|
| CN | 2550395 | Y | * | 5/2003 | ..... D06F 23/06 |
| CN | 2550395 | Y | | 5/2003 | |
| CN | 201695220 | U | | 1/2011 | |
| JP | 2001327789 | A | | 11/2001 | |
| KR | 20000071871 | A | | 11/2000 | |
| KR | 20040034235 | A | | 4/2004 | |
| KR | 1020040034235 | A | | 4/2004 | |

* cited by examiner (a)

| Test cloth 4 kg | | Power consumption [wh] | Cleaning ratio | Cleaning unevenness |
|---|---|---|---|---|
| Inclination angle θ=0° | Embodiment | 8.85 | 0.846 | 1.13 |
| | Comparison example 1 | 9.85 | 0.868 | 0.76 |

(b)

| Test cloth 4 kg | | Power consumption [wh] | Cleaning ratio | Cleaning unevenness |
|---|---|---|---|---|
| Inclination angle θ=12° | Embodiment | 9.09 | 0.928 | 0.92 |
| | Comparison example 1 | 9.77 | 0.876 | 0.67 |

FIG. 7

(a)

| Test cloth 8 kg | | Power consumption [wh] | Cleaning ratio | Cleaning unevenness |
|---|---|---|---|---|
| Inclination angle θ=0° | Embodiment | 16.28 | 0.883 | 2.24 |
| | Comparison example 1 | 18.41 | 0.968 | 1.44 |
| | Comparison example 2 | 18.63 | 0.950 | 1.06 |

(b)

| Test cloth 8 kg | | Power consumption [wh] | Cleaning ratio | Cleaning unevenness |
|---|---|---|---|---|
| Inclination angle θ=6° | Embodiment | 15.74 | 0.913 | 2.22 |
| | Comparison example 1 | 18.78 | 0.938 | 1.53 |
| | Comparison example 2 | 18.89 | 0.936 | 1.24 |

(c)

| Test cloth 8 kg | | Power consumption [wh] | Cleaning ratio | Cleaning unevenness |
|---|---|---|---|---|
| Inclination angle θ=12° | Embodiment | 16.94 | 1.025 | 1.64 |
| | Comparison example 1 | 18.79 | 0.937 | 1.27 |
| | Comparison example 2 | 19.64 | 1.001 | 1.20 |

(d)

| Test cloth 8 kg | | Power consumption [wh] | Cleaning ratio | Cleaning unevenness |
|---|---|---|---|---|
| Inclination angle θ=20° | Embodiment | 18.05 | 0.955 | 1.68 |

FIG. 8

WASHING MACHINE

TECHNICAL FIELD

The present disclosure relates to a washing machine capable of reducing the power consumption.

BACKGROUND

In the past, it is well known such a washing machine in which a bottomed cylindrical washing tank is supported inside a box-shaped main body and a disc-shaped rotary wing named as a pulsator is arranged at the bottom of the washing tank (for example, referring to the Patent Literature 1).

A rotary shaft is arranged at the center of the rotary wing, and a plurality of stirring blades centered on the rotary shaft and extending radially are formed on the surface of the rotary wing. Moreover, the rotary blades can rotate by a driving unit including a motor to stir water and washing objects put in the washing tank, so as to wash the washing objects.

EXISTING TECHNICAL LITERATURE

Patent Literature

Patent Literature 1: Japanese Laid-Open Patent Publication No. 2000-14958

SUMMARY

Problems to be Solved in the Invention

The above washing machine pays attention to basic washing performance. In order to improve cleaning ratio and cleaning unevenness which constitute an evaluation reference, improvements are gradually promoted and various solutions are proposed for the overall structure of the washing machine and the shape of the rotary wing. However, since such improvements focus on to the enhancement of washing performance, the introduction of additional value, etc., the improvement in a viewpoint for reduction of the power consumption is almost not promoted.

However, during the globalization progress in recent years, user demands have a tendency of more diversification. In order to reduce the operation cost, requirements for reducing the power consumption are increased.

Moreover, there is a demand to supply general-purpose products at lower price. As a method for this purpose, it has been considered to convert a high-cost inverter motor, which is under the premise of control performed by an inverter, into a general-purpose motor and change a motor coil to aluminum from copper. For the case of changing the motor in this way, the power consumption is increased usually along with the increase of loss in the motor. Therefore, in order to use the washing machine at the same operation cost as the existing case, the power consumption needs to be reduced as mentioned above.

The purpose of the present disclosure is to solve such problems effectively, and more particularly, to provide a washing machine capable of reducing the power consumption.

Means for Solving the Problems

In order to achieve the related purposes, the following methods are considered in the present disclosure.

That is, the washing machine of the present disclosure includes a substantially bottomed cylindrical washing tank, a rotary wing rotatably and freely arranged at the bottom of the washing tank, and a driving unit for rotatably driving the rotary wing by being powered by electricity. The rotary wing is formed in a disc shape and centered on a rotary axis, and a plurality of stirring blades radially extending towards an outer circumference are arranged on the surface of the rotary wing. The washing machine is characterized in that the center of the plurality of stirring blades is set at a position more misplaced towards an outer diameter direction than the rotary axis, and a protrusion part more protruded towards the axial direction of the rotary axis than the stirring blades is arranged at the center of the plurality of stirring blades.

In addition, the present disclosure is characterized in that the rotary axis of the rotary wing is substantially consistent with a central axis of the washing tank, and the central axis is inclined relative to a vertical axis.

Moreover, the present disclosure is characterized in that an inclination angle in which the central axis is inclined relative to the vertical axis is set to be within a range of 6-20°.

In addition, the present disclosure is characterized in that the top end of the protrusion part is formed in a partially spherical shape.

Effects of the Invention

In accordance with the present disclosure described above, since a plurality of stirring blades are centered on a position more misplaced towards the outer diameter direction than the rotary axis and arranged radially and the protrusion part is arranged at the center of the stirring blades, a water flow can be generated efficiently; moreover, the washing objects can act efficiently, so that the cleaning ratio and the cleaning unevenness can be limited in an allowable scope and the power consumption of the driving unit can be reduced. Therefore, energy consumption can be suppressed, and operation cost can be reduced.

In addition, since the power consumption can be reduced by the shape of the rotary wing, in the case that the driving unit includes a motor, a general-purpose motor can be used as the motor even if a high-price inverter motor is not used, and the overall cost reduction of the washing machine can be realized. Further, for the portion of reducing the power consumption by the shape of the rotary wing, in the case of allowing the internal loss in the motor, a usually used copper coil can be changed to an aluminum coil, and the cost is further reduced.

Specifically, according to the present disclosure in which the central axis of the washing tank and the rotary axis of the rotary wing are inclined, since the rotary wing can be made in the above shape and the washing objects generate efficient rolling movement on the surface of the rotary wing, the power consumption can be reduced and the cleaning ratio is higher than an existing cleaning ratio.

Specifically, according to the present disclosure the inclination angle is set in the range of 6-20°, the cleaning ratio can be further increased, and the improvement of the washing performance and the reduction of the power consumption can be concurrently obtained.

In addition, according to the present disclosure in which the top end of the protrusion part is formed in the partially spherical shape, an effect of enabling the washing objects to act by the protrusion part is obtained, at the same time, the damage to the washing objects caused by the protrusion part can be suppressed, so as to wash the washing objects ideally.

BRIEF DESCRIPTION OF DRAWINGS

FIG. 7 is a diagram illustrating evaluation results of the same washing machine together with a comparison example.

FIG. 8 is a diagram illustrating evaluation results of the same washing machine together with comparison examples.

DETAILED DESCRIPTION

Embodiments of the present disclosure are described below with reference to drawings.

Figure 1:
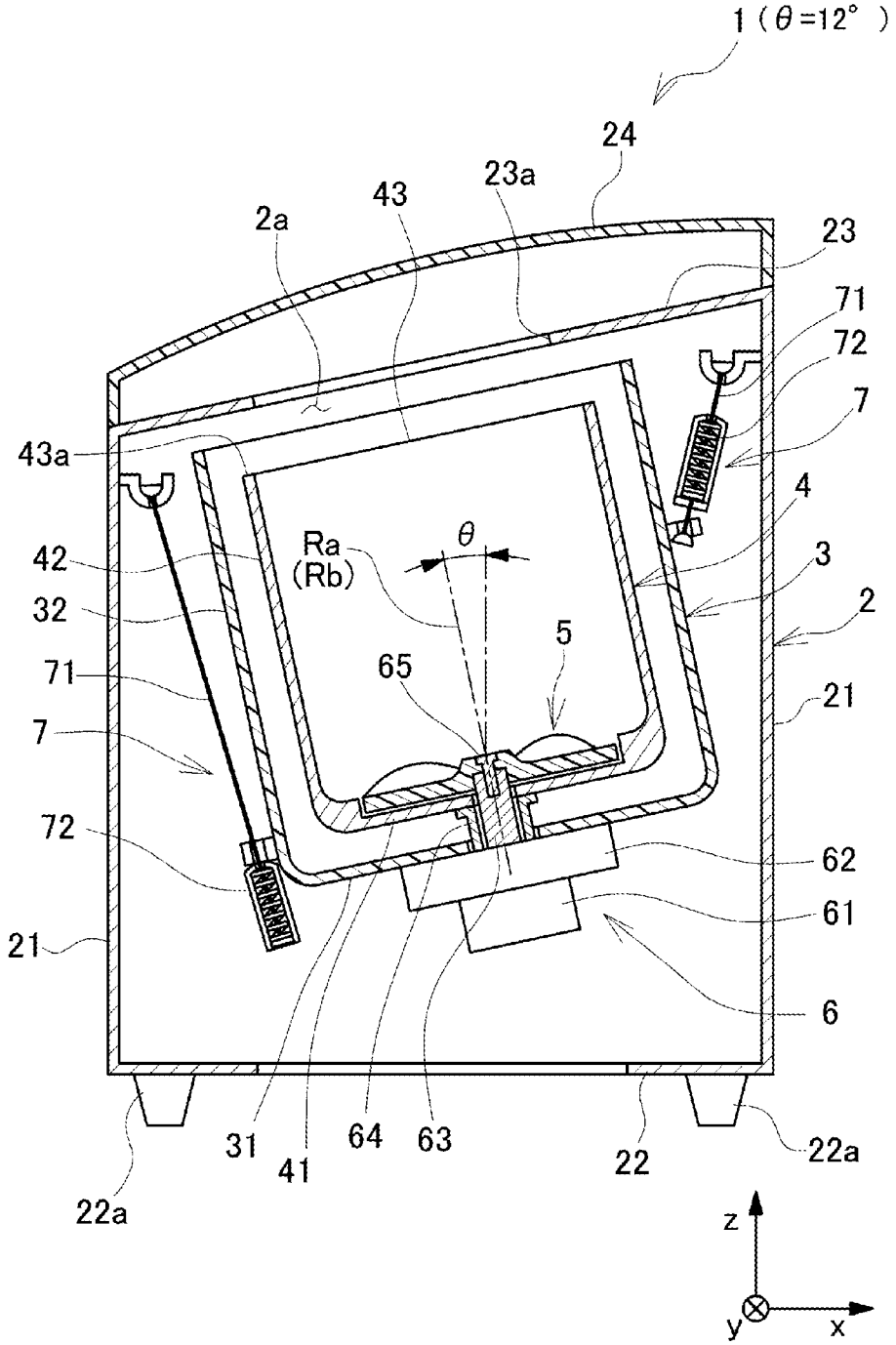
FIG. 1 is a longitudinal sectional view illustrating a washing machine according to one embodiment of the present disclosure.

FIG. 1 a longitudinal sectional view illustrating a washing machine 1 according to one embodiment of the disclosure. The washing machine 1 described in the figure shows a general structure and parts unrelated to the present disclosure are omitted.

The washing machine 1 includes a main body 2, an outer tank 3, a washing tank 4, a rotary wing 5 and a driving unit 6.

Here, in the present embodiment, a depth direction of the main body 2 is defined as an x direction, a width direction is defined as a y direction, and a vertical direction is defined as a z direction. These x, y, z directions are mutually intersect to form a coordinate system shown in the figure. In addition, the x direction uses a direction from a front side towards a rear side of the washing machine 1 as a reference, and the front side of the washing machine 1 refers to a standing position side of a user when using the washing machine 1. The description below is made in accordance with the above coordinate system.

The main body 2 includes a bottom plate 22 in a substantially rectangle shape seen from the top, four side plates 21 forming four sides erected from the edges, and a top plate 23 connected with the upper part, which are integrally form a substantially cuboid shape and which are surrounded to form an inner space 2*a* in a substantially cuboid shape. Feet 22*a* capable of installing the main body 2 on a floor surface are arranged in the vicinity of four corners of a lower surface of the bottom plate 22. In addition, the top plate 23 is parallel to the opening edge 43 of the washing tank 4 described later, and is slightly obliquely disposed forwardly in coordination with the inclination of the washing tank 4 in the present embodiment. Moreover, a substantially circular opening 23*a* is formed in the vicinity of the center of the top plate 23, and the washing objects can be taken out from or put into the washing tank 4 through the opening 23*a*. Further, a cover member 24 capable of opening and closing the opening 23*a* is arranged at the upper part of the top plate 23.

The outer tank 3 is formed of synthetic resin and is a substantially bottomed cylindrical member having a substantially circular bottom plate 31 and a side plate 32 erected from the edge part of the bottom plate 31. In addition, in the outer tank 3, the shape of the bottom plate 31 can also be changed into a polygonal shape, and the like. It is sufficient to only form a substantially bottomed cylindrical shape. The outer tank 3 is hung by four hanging bars 7 arranged at the four corners of the inner space 2*a* of the main body 2, and the outer tank 3 is inclined forwardly relative to the vertical axis (z axis) by changing the length of each handing bar 7 and the engagement positions of the hanging bars 7 with the outer tank 3. Each hanging bar 7 is composed of a bar body 71 and a suspending bracket 72 arranged at the top end thereof, absorbing the displacement of the outer tank 3 and elastically supporting the outer tank 3.

The washing tank 4 is made of metal and is a substantially bottomed cylindrical member having a substantially circular bottom plate 41 seen from the top and a side plate 42 erected from the edge part of the bottom plate 41. The washing tank 4 is coaxially arranged with the outer tank 3 inside the outer tank 3, and is rotatably and freely supported by the outer tank 3. In addition, the washing tank 4 also has the function of a dewatering tank. The side plate 42 and the bottom plate 41 are provided with a plurality of openings (not shown), through which the water in the washing tank 4 can be discharged. In addition, the washing tank 4 is the same as the outer tank 3, the bottom plate 41 is not needed to be made into a circle, and it is sufficient to only change the shape of the bottom plate 41 to form a substantially bottomed cylindrical shape.

The bottom of the washing tank 4 is rotatably and freely provided with a rotary wing 5 with a substantially disc shape. A rotary axis Ra of the rotary wing 5 is consistent with a central axis Rb of the washing tank 4 with the substantially cylindrical shape. That is, the rotary axis Ra of the rotary wing 5 is also consistent with a central axis of the outer tank 3, and like the outer tank 3, is inclined forwardly from the vertical axis (z axis). Here, the inclination of the rotary axis Ra and the central axis Rb of the washing tank 4 is defined as an inclination angle θ by using the vertical axis (z axis) as a reference. The larger the inclination angle θ is, the more the front side 43*a* of the opening edge 43 of the washing tank 4 is lowered, being easy to take out or put in the washing objects. In the example shown in FIG. 1, although the inclination angle θ is set to 12°, the inclination angle θ is not limited to 12° as mentioned below.

The driving unit 6 is fixed below the outer tank 3 and includes a motor 61 which rotates by being powered by electricity, a speed reducer 62 as well as a first output shaft 63 and a second output shaft 64 that are rotated by torque of the motor 61. The motor 61 is configured as a brushless motor; and like a general-purpose motor, a coil is made of copper. In addition, the motor 61 is also an inverter motor driven by an inverter and the frequency and voltage being applied are controlled by the inverter (not shown) so as to perform control at good efficiency.

The second output shaft 64 is formed in a cylindrical shape and coaxially arranged with the first output shaft 63. The first output shaft 63 penetrates into the interior of the washing tank 4, and top end of the first output shaft is embedded into a shaft sleeve part 51 (refer to FIG. 3) formed in the rotary wing 5 and is fixed by a mounting screw 65. Therefore, the rotary wing 5 and the first output shaft 63 rotate integrally. Top end of the second output shaft 64 is fixed to the bottom plate 41 of the washing tank 4. Therefore, the washing tank 4 and the second output shaft 64 rotate integrally.

The above motor 61 is provided with a clutch mechanism (not shown). Through switching on and off of the clutch mechanism, a first operation mode in which only the first output shaft 63 is rotated by the torque of the motor 61 and a second operation mode in which the first and second output shafts 63, 64 are rotated simultaneously can be switched. Further, in the first operation mode, the torque of the motor 61 can be transmitted to the first output shaft 63 via the speed reducer 62 to operate the first output shaft at low speed and high torque. The above first operation mode corresponds to the operation for washing in which the rotary wing 5 is rotated while the washing tank 4 is stopped, and the second operation mode corresponds to the operation for dewatering in which the washing tank 4 and the rotary wing 5 are rotated simultaneously at high speed.

Figure 2:
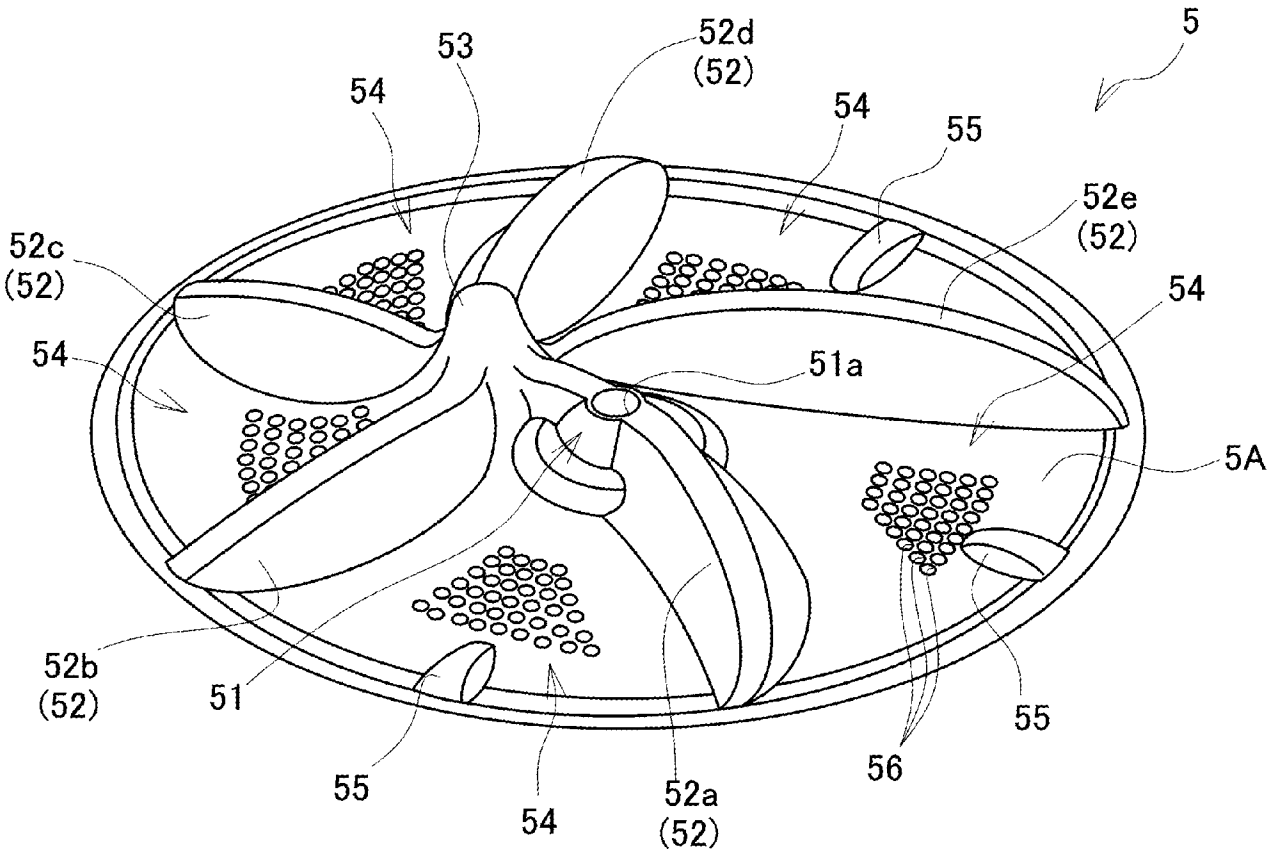
FIG. 2 is a perspective view illustrating a rotary wing of the same washing machine.
Figure 3:
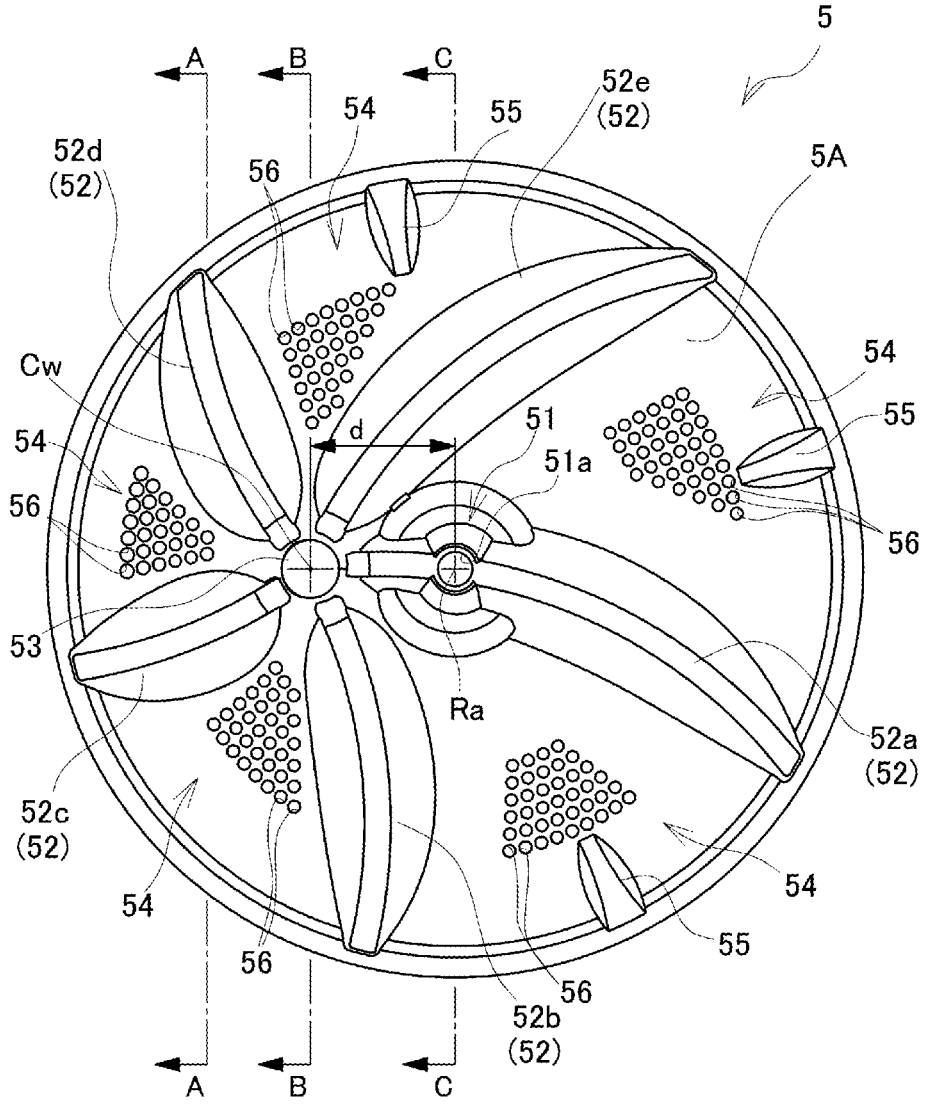
FIG. 3 is a view illustrating a state of observing of the same rotary wing from a direction of a rotary axis.

FIG. 2 is a perspective view illustrating the above rotary wing 5, and FIG. 3 is a view for observing a surface side of the rotary wing 5 from a direction of a rotary axis. Here, the surface side of the rotary wing 5 refers to a side which is in contact with the washing objects in a position above the washing tank 4 when it is mounted thereon (refer to FIG. 1). Moreover, FIGS. 4(*a*), (*b*), (*c*) are respectively the sectional views at A-A, B-B and C-C positions in FIG. 3.

Figure 4:
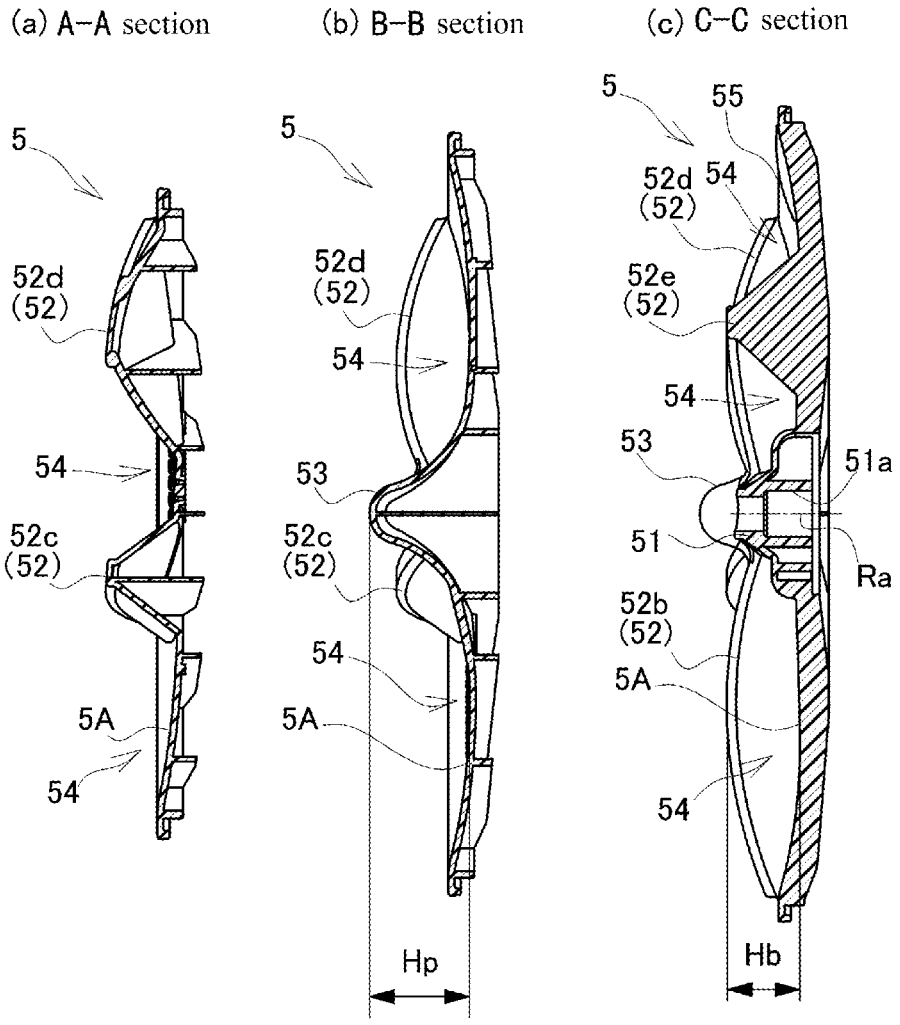
FIG. 4 is a view illustrating A-A section, B-B section and C-C section in FIG. 3.

As shown in FIGS. 2 to 4, the rotary wing 5 in the present embodiment is a disc-shaped rotary wing substantially centered on the rotary axis Ra. Specifically, based on a disc part 5A forming in the disc shape, the shaft sleeve part 51, stirring blades 52 and a protrusion part 53 are integrally formed on the face (surface) of the surface side thereof.

The shaft sleeve part 51 is a component for installing the rotary wing 5 on the first output shaft 63 (refer to FIG. 1), and is formed at the center of the rotary wing 5. The shaft sleeve part 51 is more protruded towards the axial direction of the rotary axis Ra than the disc part 5A and is formed more thicker than other parts; and a through hole 51*a* for inserting the first output shaft 63 (refer to FIG. 1) from the back side is formed at the center of the shaft sleeve part. Therefore, as mentioned above, the rotary wing 5 can be fixed to the first output shaft 63 by inserting the first output shaft 63 (refer to FIG. 1) into the through hole 51*a* from the back side and screwing the mounting screw 65 into a screw hole (not shown) (refer to FIG. 1) formed at the top end of the first output shaft 63.

The stirring blades 52 and the shaft sleeve part 51 are also arranged at the surface side of the rotary wing 5, and like the shaft sleeve part 51, are protruded towards the axial direction of the rotary axis Ra from the disc part 5A. More specifically, observing the stirring blades 52 from the axial direction, five stirring blades 52*a*-52*e* are arranged around the center Cw, which is at a position misplacing from the rotary axis Ra to the radial direction of the disc part 5A and towards the outer edge. These stirring blades 52*a*-52*e* extend radially from the center Cw towards the outer circumference of the rotary wing 5. Hereafter, in the case of describing the designated stirring blades, the reference numerals of the stirring blades 52*a*-52*e* are used; and in the case of no need of special distinction, the reference numeral of the stirring blades 52 is used. In the present embodiment, a distance d from the rotary axis Ra to the center Cw of the stirring blades 52 is set to be about ⅓ of the radius of the rotary wing 5. In addition, as shown in FIG. 3, each stirring blade 52 is bent in a manner of gradually advancing clockwise towards the outer circumference.

In addition, each stirring blade 52 is formed to be slightly protruded and bend relative to the axial direction during the extension from center Cw towards the outer circumference. Specifically, the axial height is slightly small in the vicinity of the center Cw, is maximum in the middle of extending towards the outer circumference, and is small again in the vicinity of the outer circumference.

As mentioned above, since five stirring blades 52*a*-52*e* are protruded towards the axial direction of the rotary axis Ra, recesses 54 with reduced axial height are respectively formed among the stirring blades 52 and 52. In this way, at the surface side of the rotary wing 5, concave and convex portions are formed by forming the stirring blades 52*a*-52*e* and the recesses 54 among them, so that the cleaning effect can be improved by rotating the washing objects among the concave and convex portions. Further, since the stirring blades 52*a*-52*e* have different lengths and angles that the stirring blades 52*a*-52*e* collide with the washing objects are different, the portions of the washing objects to be cleaned by the stirring blades 52*a*-52*e* are different, and the washing performance can be further improved.

In addition, among the above recesses 54 having wide areas, in a recess 54 between the stirring blades 52*d* and 52*e*, a recess 54 between the stirring blades 52*e* and 52*a* and a recess 54 between the stirring blades 52*a* and 52*b*, baffle plate parts 55, which are slightly protruded axially in the vicinity of the outer circumference, are formed, respectively. Therefore, the baffle plate parts 55 are in contact with the washing objects in the recesses 54 to further improve the washing performance.

Further, the disc part 5A is provided with a plurality of through holes 56 through which water stream passes between the surface side and the back side at positions corresponding to each recess 54.

One stirring blade 52*a* of the stirring blades 52*a*-52*e* is formed by extending from the center Cw towards the outer circumference through the rotary axis Ra to share with a part of the above shaft sleeve part 51. Therefore, the strength of the shaft sleeve part 51 can be ensured even if it is not particularly large, and the rotary wing 5 is securely installed on the first output shaft 63 (refer to FIG. 1) using the shaft sleeve part 51. In addition, as compared with the case that the shaft sleeve part 51 is arranged between the plurality of stirring blades 52, the recesses 54 between the stirring blades 52 and 52 can be prevented from becoming small, a space for rolling movement of the washing objects can be ensured, and the reduction of the washing performance can be suppressed.

The protrusion part 53 is a component arranged at the center Cw, which is a base end portion of the above plurality of stirring blades 52*a*-52*e*, and is protruded from the disc part 5*a* towards the surface side along the axial direction of the rotary axis Ra. Here, the protrusion amount Hp of the protrusion part 53 is defined as a maximum size between a face (surface) of the surface side of the disc part 5A and the top end of the protrusion part 53 in a direction parallel to the rotary axis Ra (refer to FIG. 4). Moreover, for comparison, the protrusion amount Hb of the stirring blade 52 is also defined (refer to FIG. 4). In the present embodiment, although the protrusion amount Hp of the protrusion part 53 is set to be about 1.5 times of the protrusion amount Hb of the stirring blade 52, the size can be suitably changed.

In addition, each of the stirring blades 52*a*-52*e* is in smooth connection with the protrusion part 53. Moreover, since the top end of the protrusion part 53 is formed in a smooth, partially spherical shape, in the case that it is in contact with the washing objects to move them, the washing objects are not damaged, and washing can be performed ideally.

As mentioned above, the protrusion amount Hp of the protrusion part 53 is set to be larger than that of the stirring blade 52. However, since the protrusion part 53 is arranged at the position misplacing from the rotary axis Ra by the distance d towards the outer diameter direction, the protrusion part 53 can efficiently act on the washing objects, and the plurality of stirring blades 52 can cooperate with the effect generated by the concave and convex portions formed on the surface of the rotary wing 5, efficiently performing the washing.

In addition, according to the insight of the inventor, the stirring effect on the washing objects can be further improved as long as the distance d is increased. Therefore, in the case of increasing the inclination angle θ (refer to FIG. 1) of the rotary axis Ra (central axis Rb), although there is a trend that the washing objects are deflected toward one direction of the washing tank 4 due to gravity, even in such case, the washing can be performed ideally through the stirring effect produced by the protrusion part 53. Therefore, it is suitable to change the distance d in accordance with the magnitude of the inclination angle θ. In addition, it is also suitable to change the protrusion amount Hp of the protrusion part 53 in accordance with the magnitude of the inclination angle θ.

As shown in FIGS. 4(*a*)-(*c*), on the back side of the rotary wing 5, ribs for reducing the wall thickness for lightweight and improving the strength are formed.

Although the washing machine 1 in the present embodiment has the above structure, the inclination angle θ shown in FIG. 1 (refer to the figure) can also be changed to form the washing machine 1.

Figure 5:
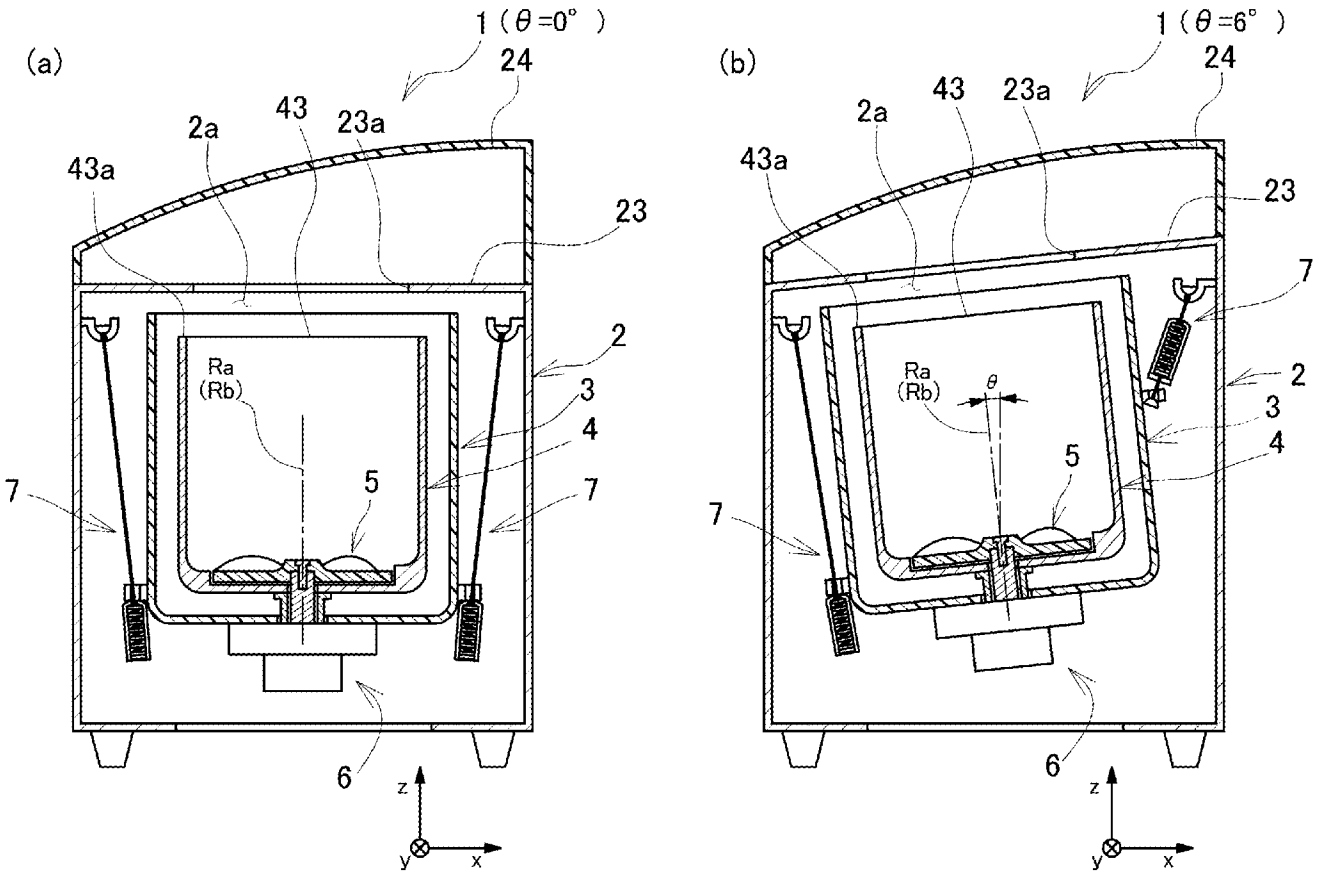
FIG. 5 is a longitudinal sectional view illustrating examples of changing an inclination angle of a washing tank.
Figure 6:
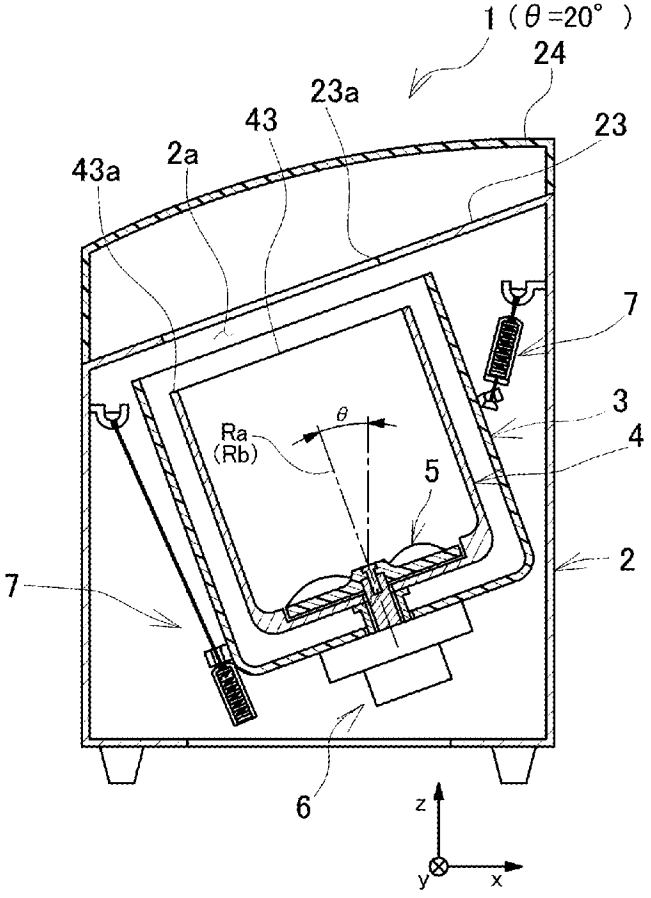
FIG. 6 is a longitudinal sectional view illustrating an example of further changing the inclination angle of the washing tank.

FIGS. 5 and 6 are the longitudinal sectional views illustrating examples of changing the inclination angle θ to be different from that in FIG. 1. In FIG. 1, although the inclination angle θ is set to θ=12°, the inclination angle θ can also be set to θ=0° as shown in FIG. 5(*a*), is set to 6° as shown in FIG. 5(*b*), and is set to 20° as shown in FIG. 6.

The examples shown in FIGS. 5(*a*), (*b*) and 6 are examples in which the inclination angle θ of the washing tank 4 is changed according to the example shown in FIG. 1 and the angle of the top plate 23 of the main body 2 is changed together with the inclination of the opening edge 43 of the washing tank 4. In addition, in order to change the inclination angle θ of the washing tank 4 respectively, the length of the handing bar 7 and the engagement position of the outer tank 3 are suitably changed.

As compared with the example shown in FIG. 1, in the examples shown in FIGS. 5(*a*) and (*b*), although the decrease of the inclination angle θ is slightly unfavorable to easiness of taking out or putting in the washing objects from the washing tank 4, as mentioned below, almost constant effects can be obtained in terms of power consumption and washing performance. On the other hand, as compared with the example shown in FIG. 1, in the example in FIG. 6, the increase of the inclination angle θ is more favorable to easiness of taking out or putting in the washing objects from the washing tank 4, and as mentioned below, the same effects can be obtained in terms of the power consumption and the washing performance.

Comparison between evaluation results of the embodiments of the present disclosure, which are constructed in the manner as shown in FIGS. 1, 5(*a*), 5(*b*) and 6 specialized to the washing machine 1 of the present embodiment and of a comparison example is described.

Figure 12:
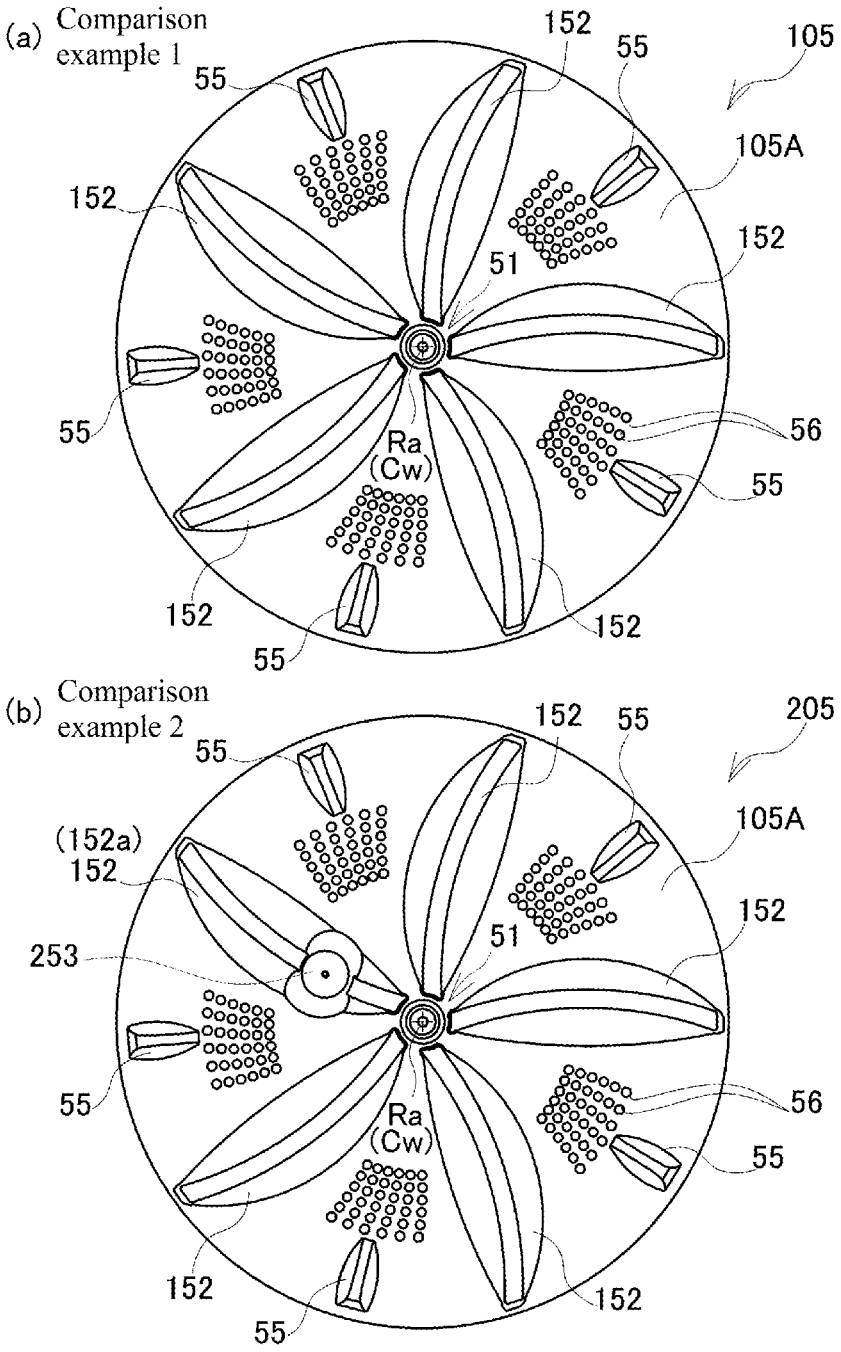
FIG. 12 is a view illustrating a rotary wing of a comparison example for comparison with the present embodiment.

FIGS. 12(*a*) and (*b*) are views illustrating a rotary wing 105 used in the comparison example 1 and a rotary wing 205 used in the comparison example 2, respectively, as compared with the embodiments of the present disclosure. These views correspond to FIG. 3 and show the surface sides of the rotary wings 105 and 205 observing from the direction of the rotary axis. The parts common to FIG. 3 can be assigned with the same reference numerals and the detailed description is omitted. In addition, the rotary wings 105 and 205 shown in FIG. 12 are set to have the same outer diameter size as the rotary wing 5 shown in FIG. 3.

The rotary wing 105 used in the comparison example 1 shown in FIG. 12 is an existing common component. The center portion of a disc part 105A is formed with a shaft sleeve part 51, and five stirring blades 152 are centered on the shaft sleeve part 51 and formed radially. That is, the rotary axis Ra of the rotary wing 105 is consistent with the center Cw of the five stirring blades 152. In addition, the baffle plate parts 55 and through holes 56 are respectively formed between adjacent stirring blades 152 and 152. Furthermore, the protrusion amount Hb (refer to FIG. 4) of the stirring blade 152 and the shape of the baffle plate part 55 are the same as those of the rotary wing 5 (refer to FIGS. 1-4) in the washing machine 1 of the present embodiment.

The rotary wing 205 used in the comparison example 2 is a rotary wing provided with a protrusion part 253 on the rotary wing 105 used in the above comparison example 1. Specifically, a portion is shared and the protrusion part 253 is arranged at a position overlapping one stirring blade 152*a* of the stirring blades 152. The distance from the center of the protrusion part 253 to the rotary axis Ra is the same as that of the rotary wing 5 (refer to FIG. 3) in the above embodiment, and is set to be about ⅓ of the radius of the rotary wing 205. In addition, the protrusion amount Hp of the protrusion part 253 is also set to be the same as that of the rotary wing 5 (refer to FIGS. 1-4).

The comparison example 1 and the comparison example 2 are based on the washing machine 1 shown in FIGS. 1, 5(*a*) and 5(*b*), in place of the rotary wing 5 (refer to FIGS. 1-4) constituting the washing machine, the rotary wings 105 and 205 are respectively assembled and evaluated. That is, similar to a portion of the embodiment, evaluation is performed by using three standards of the inclination angle θ being 0°, 6° and 12°.

The evaluation of the washing machine 1 was performed based on the performance evaluation standard of the washing machine prescribed by Japan Electrical Manufacturers' Association (JEMA) of general corporation legal body, and evaluation items include power consumption, cleaning ratio and cleaning unevenness.

Matched with the data of sampling the above three evaluation items, the experiment conditions were set based on a washing performance evaluation method described in the performance evaluation standard of the washing machine. That is, a predetermined amount of test cloth including wet artificial stain cloth (hereinafter referred to as "stain cloth"), water and detergent were put in a predetermined order and operated. At this moment, the test conditions were set as follows: the water temperature being 20□; the hardness of the water quality being 40 ppm (mg/L); and a cleaning process being carried out for only 10 minutes. Further, the amount of the test cloth was set as two references of 4 kg and 8 kg. The water amount was set to 47 L in the case of the test cloth being 4 kg; and the water amount was set to 60 L in the case of the test cloth being 8 kg. The same synthetic detergent on the market was used as the detergent, and the predetermined amount was put in according to the respective water amount.

When operation was performed under the above conditions, the value measured by an accumulated wattmeter was set as the power consumption (wh). In addition, the power consumption was mainly the power consumed by the motor 61 constituting the above driving unit 6. Further, the cleaning degree was calculated according to the reflectivity of the stain cloth before and after operation and the reflectivity of the same kind of cloth sample, and the cleaning ratio was obtained as a ratio to the cleaning degree of the standard washing machine. Then, a standard deviation of the cleaning degree was obtained, and the cleaning unevenness was obtained as a ratio to the standard deviation of the standard washing machine. The cleaning ratio and the cleaning unevenness can be used as indicators showing the washing performance (cleaning performance) of the washing machine.

In addition, although it goes without saying that the smaller the value of the power consumption the better, the greater the value of the cleaning ratio the better, and the smaller the value of the cleaning unevenness the better. However, the target washing performance of the cleaning ratio being no less than 0.8 and the cleaning unevenness being no more than 3 is defined in the performance evaluation standard of the washing machine prescribed by JEMA, which is also defined as the reference in the present embodiment.

FIGS. 7 and 8 are diagrams summarizing the operation results under the above conditions and show the evaluation results of the washing machine 1 in the present embodiment as shown in FIGS. 1 and 5 and of the comparison examples.

FIG. 7(*a*) is a diagram illustrating the evaluation results of the washing machine 1 of the present embodiment having the rotary wing 5 (refer to FIGS. 1-4) and of the washing machine 1 in the comparison example 1 having the rotary wing 105 (refer to FIG. 12 (*a*)) when the test cloth is 4 kg and the inclination angle θ is 0° (refer to FIG. 5(*a*)). In the results, as compared with the comparison example 1, the power consumption is significantly reduced in the present embodiment. In addition, although the cleaning ratio and the cleaning unevenness are slightly inferior to those of the comparison example 1, the above target washing performance is satisfied.

FIG. 7 (*b*) is a diagram illustrating the evaluation results when the inclination angle θ is changed to 12° (refer to FIG. 1) according to the condition of FIG. 7(*a*). In this case, as compared with the comparison example 1, the power consumption is also significantly reduced in the present embodiment. In addition, the target washing performance of the cleaning ratio and the cleaning unevenness is satisfied, wherein although the cleaning unevenness is slightly inferior to that of the comparison example 1, the cleaning ratio is better than that of the comparison example 1.

FIG. 8(*a*) is a diagram illustrating the evaluation results of the washing machine of the present embodiment having the rotary wing 5 (refer to FIGS. 1-4), of the washing machine 1 in the comparison example 1 having the rotary wing 105 (refer to FIG. 12 (*a*)) and of the washing machine 1 in the comparison example 2 having the rotary wing 205 (refer to FIG. 12 (*b*)) when the test cloth is 8 kg and the inclination angle θ is 0° (refer to FIG. 5(*a*)). Similarly, FIG. 8(*b*) is a diagram illustrating the evaluation results when the test cloth is 8 kg and the inclination angle θ is set to be 6° (refer to FIG. 5(*b*)), FIG. 8(*c*) is a diagram illustrating the evaluation results when the test cloth is 8 Kg and the inclination angle θ is to be 12° (refer to FIG. 1), and FIG. 8 (*d*) is a diagram only illustrating the evaluation result of the washing machine 1 in the embodiment having the rotary wing 5 (refer to FIGS. 1-4) when the test cloth is 8 kg and the inclination angle θ is set to be 20° (refer to FIG. 6).

Figure 9:
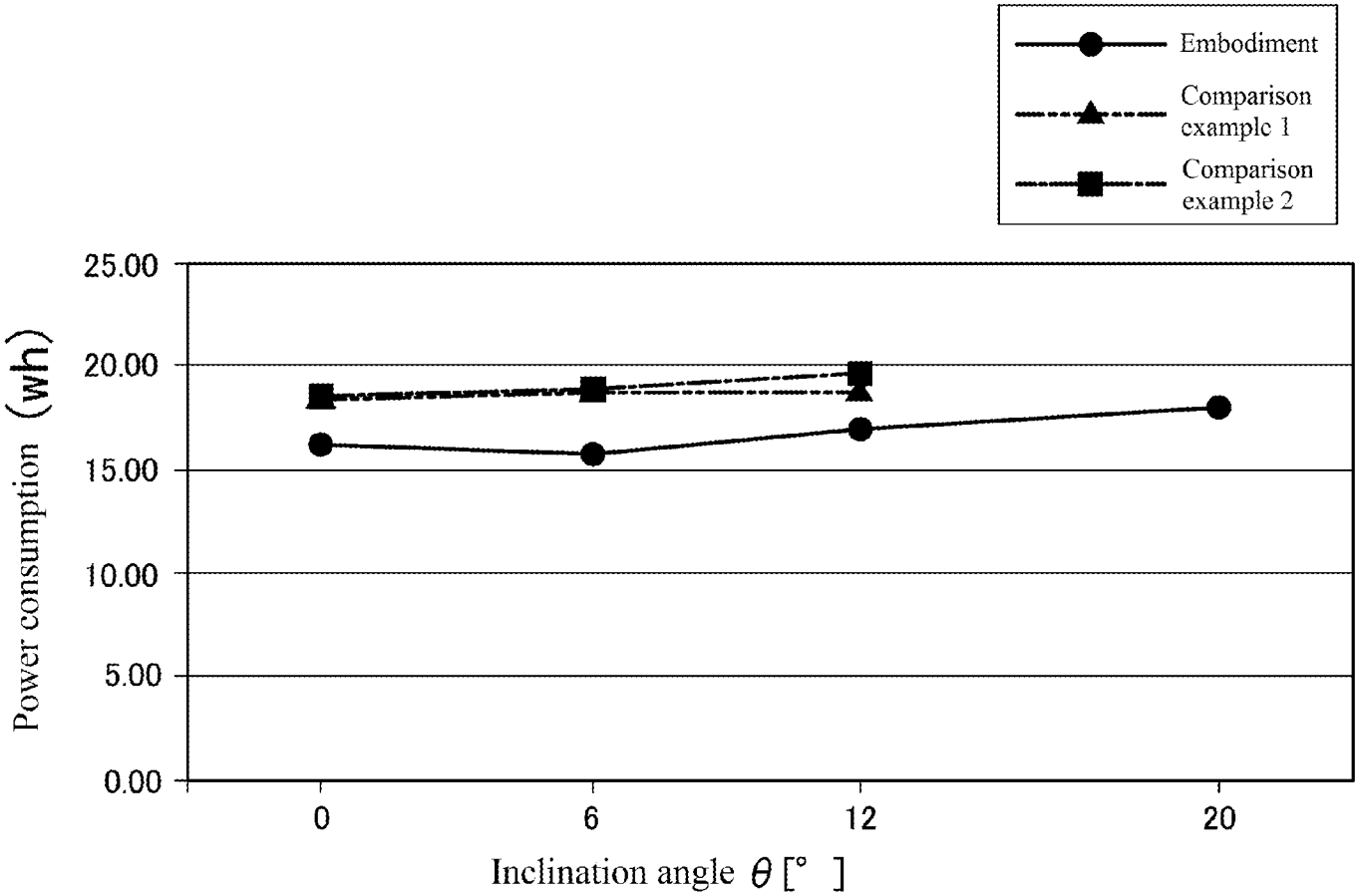
FIG. 9 is a diagram illustrating a relationship between an inclination angle and power consumption based on the evaluation results of FIG. 8.
Figure 10:
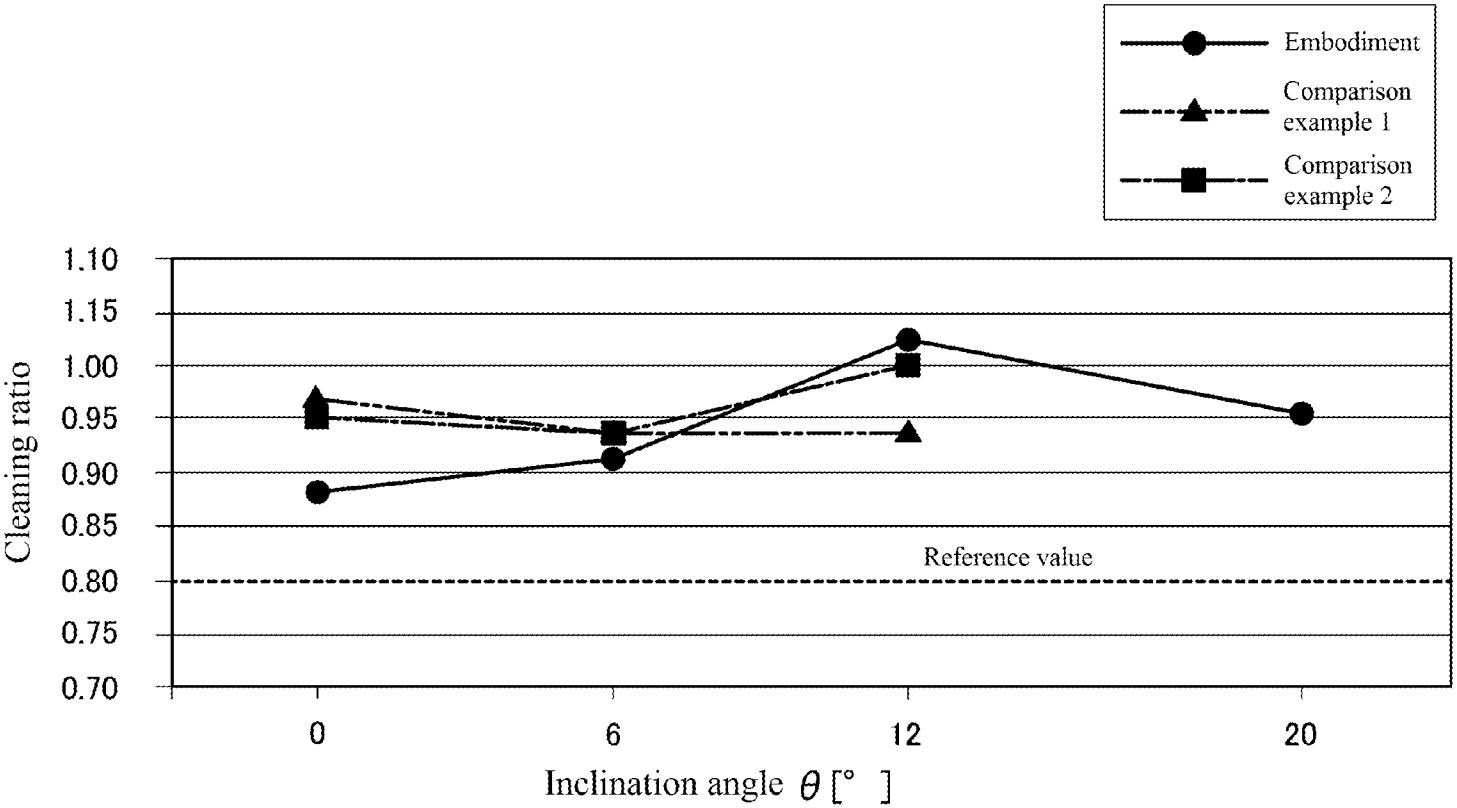
FIG. 10 is a diagram illustrating a relationship between the inclination angle and a cleaning ratio based on the evaluation results of FIG. 8.
Figure 11:
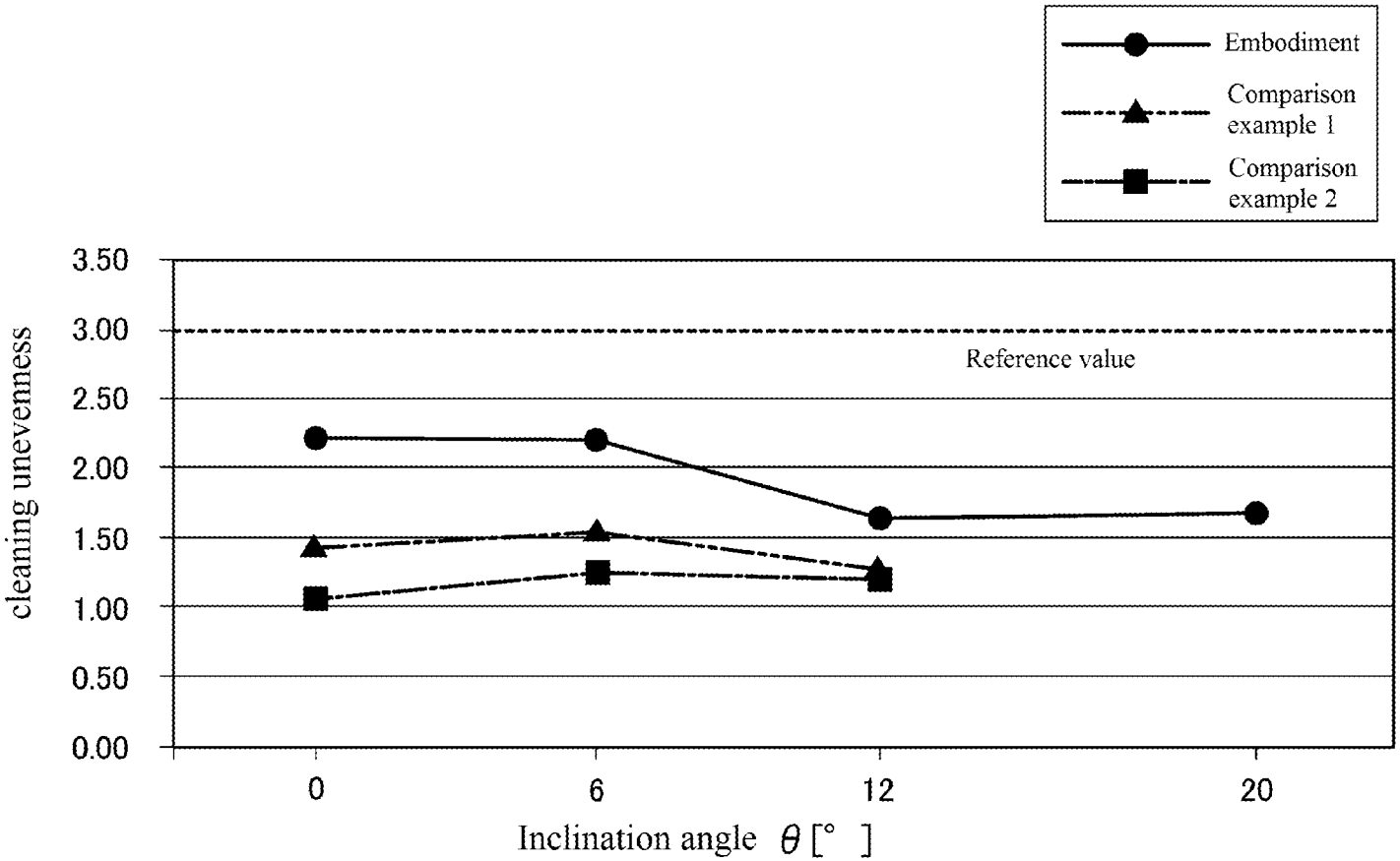
FIG. 11 is a diagram illustrating a relationship between the inclination angle and cleaning unevenness based on the evaluation results of FIG. 8.

Further, FIGS. 9, 10 and 11 are diagrams graphically illustrating the power consumption, the cleaning ratio and the cleaning unevenness in the vertical axis and the inclination angle θ in the horizontal axis, based on the contents in FIGS. 8(*a*)-(*d*).

With a view to the power consumption shown in FIG. 9, in the range of the inclination angle θ being 0-12°, the power consumption of the embodiment is less than that of the comparison examples 1 and 2 by about 10%. Similarly, although this is only the evaluation result of the embodiment, it can be understood that the power consumption is small enough when the inclination angle θ is set to be 20°. Specifically, although the power consumption is the maximum when the inclination angle θ is set to be 20° in the embodiment, the power consumption is small enough as compared with the results of the inclination angle θ being 0-12° in the comparison examples 1 and 2. In this way, since the embodiment obtains almost the same tendency that the power consumption becomes small in the range of the evaluated inclination angle θ being 0-20°, the shape of the rotary wing 5 is largely influenced the power consumption. That is, the power consumption can be ideally reduced by using the rotary wing 5 (refer to FIGS. 1-4) of the present embodiment.

That is, as shown in FIGS. 2-4, the center Cw of the plurality of stirring blades 52 is set at the position more misplaced towards the outer diameter direction than the rotary axis Ra, and the protrusion part 53 more protruded towards the axial direction of the rotary axis Ra than the stirring blade 52 is arranged at the center Cw, so that the action on the water and the washing objects in the washing tank 4 can be effectively performed, and the power consumption generated by the motor 61 can be reduced.

In addition, with a view to the cleaning ration shown in FIG. 10, value exceeding 0.80 of the cleaning ratio as the target washing performance is obtained in the range of the inclination angle θ being 0-20° in the embodiment. That is, besides reducing the power consumption as mentioned above, the cleaning ratio exceeding the target can also be obtained in the embodiment.

However, in the embodiment, when the inclination angle θ is 0°, the cleaning ratio is slightly smaller than that of the comparison examples 1 and 2; when the inclination angle θ is 6°, the cleaning ratio is almost the same as that of the comparison examples 1 and 2; and when the inclination angle θ is 12°, the cleaning ratio is greater than that of the comparison examples 1 and 2. In addition, a peak value of the cleaning ratio is obtained when the inclination angle θ is 12°; and although the cleaning ratio is reduced again when the inclination angle θ is 20°, even if in this case, the level greater than the cleaning ratio in the comparison examples 1 and 2 is averagely maintained. That is, from the viewpoint of the cleaning ratio, although it is suitable ideally in the range of all the inclination angle θ, it can also be more suitable in the range of the inclination angle θ being 6-20°.

Further, since greater cleaning ratio can be realized when the inclination angle θ is about 12°, it can be further ideally suitable.

In addition, in the comparison example 1 having the rotary wing 105, which is the same as the existing rotary wing, as the inclination angle θ is increased from 0° to 12°, the cleaning ratio is slightly reduced gradually, while in the embodiment, the cleaning ratio has a tendency of being greatly increased. Further, in the comparison example 2 having the protrusion part 253, by increasing the inclination angle θ from 6° to 12°, the cleaning ratio also has a tendency of being greatly increased. Therefore, it can be understood that by setting the inclination angle θ to exceed 0°, specifically by setting to a great value about 12° and generating a superimposed effect by the structure of the protrusion part 53 (253), the cleaning ratio is increased.

Observed by the inventor during evaluation, it can be inferred that the protrusion part 53 (253) can lift the washing objects in a direction opposite to the inclination direction; the washing objects have a tendency of rolling movement along the inclination direction; and the cleaning ratio is increased by the movement of the washing objects. Further, it can be contemplated that the effect is generated by the above movement of the washing objects as implemented; and the cleaning ratio can be further increased by misplacing the center Cw of the stirring blades 52 from the rotary axis Ra. Therefore, matching with the effect, it can be contemplated that when the inclination angle is 12°, the maximum cleaning ratio can be obtained. Considering from such tendency and the inferred effect, even if the inclination angle θ is set to be greater than 12°, a greater cleaning ratio is expected to be obtained.

Further, with a view to the cleaning unevenness shown in FIG. 11, value below 3 of the cleaning unevenness as the target washing performance is obtained in the range of the inclination angle θ being 0-20° in the embodiment. That is, besides reducing the power consumption as mentioned above, better performance can also be obtained in terms of the cleaning unevenness.

However, in the embodiment, when the inclination angle θ is 0° and 6°, the cleaning unevenness is greater than that of the comparison examples 1 and 2; and when the inclination angle θ is 12°, the cleaning unevenness has the same level as that of the comparison examples 1 and 2. Although only the evaluation result of the embodiment is obtained when the inclination angle is 20°, a good level equivalent to that in the inclination angle θ of 12° is obtained. That is, it can be ideally suitable in the range of all the inclination angle θ, wherein it can also be ideally suitable by setting the inclination angle θ being about 12-20°.

As mentioned above, the cleaning ratio and the cleaning unevenness of the washing machine 1 in the embodiment are within the range of the target washing performance, and the power consumption can be greatly reduced. Therefore, in the case of using the above structure, the operation cost can be expected to be reduced.

In addition, for the portion with the effect of reducing power consumption, as long as a motor 61 with low efficiency is allowed to be adopted, the manufacturing cost can be reduced by using a general-purpose motor. Furthermore, the coil can be considered to be changed to an aluminum coil from a copper coil. In this case, like the case of using the general-purpose motor, the manufacturing cost can be reduced.

Although the embodiment of the present disclosure is described above, specific structures of all parts are not limited to the above embodiment.

For example, in the above embodiment, although the washing tank simultaneously has the function of a dewatering tank, namely, used as a washing and dewatering tank, the washing tank can be used as a pure washing tank 4 without the function of the dewatering tank. In this case, it is also suitable to the present disclosure and the same effect can be obtained. In this case, the outer tank 3 is not required, and the washing tank 4 can rotate without the need of the driving unit 6.

Further, in the above embodiment, although the rotary axis Ra is parallel to or inclined relative to the vertical axis (z axis), the above rotary wing 5 can also be applied in a drum washing machine in which the inclination angle θ is set to be 90°, that is, the washing tank 4 is opened in a horizontal direction.

A LIST OF REFERENCE NUMERALS

1: washing machine; 4: washing tank; 5: rotary wing; 6: driving unit; 51: shaft sleeve part; 52, 52*a*-52*e*: stirring blade; 53: protrusion part; Cw: center (of a plurality of stirring blades); Ra: rotary axis; Rb: central axis (of the washing tank); θ: inclination angle.

What is claimed is:

1. A washing machine comprising a substantially bottomed cylindrical washing tank, a rotary wing rotatably and freely arranged at a bottom of the washing tank, a plurality of ribs and a driving unit for rotatably driving the rotary wing by being powered by electricity; the rotary wing is formed in a disc shape and centered on a rotary axis, and a plurality of stirring blades, each of the stirring blades radially extending through a middle of each of the stirring blades towards an outer circumference are arranged on a surface of the rotary wing, wherein a center of the plurality of stirring blades is set at a position more misplaced towards an outer diameter direction than the rotary axis, and a protrusion part more protruded towards an axial direction of the rotary axis than the stirring blades is arranged at the center of the plurality of stirring blades wherein each stirring blade is formed to be slightly protruded and bend relative to the axial direction during extension from the center towards the outer circumference, wherein each stirring blade has an axial height that is at a maximum in the middle of the stirring blade as it extends towards the outer circumference, and wherein the axial height of each stirring blade in the vicinity of the outer circumference is smaller than the axial height at the middle of the stirring blade wherein the plurality of ribs are disposed at a preset interval on a back side of the rotary wing, and are configured for reducing a thickness and weight of the rotary wing and improving strength of the rotary wing.

2. The washing machine according to claim 1, wherein the rotary axis of the rotary wing is substantially consistent with a central axis of the washing tank, and the central axis is inclined relative to a vertical axis.

3. The washing machine according to claim 2, wherein an inclination angle in which the central axis is inclined relative to the vertical axis is set to be within a range of 6-20°.

4. The washing machine according to claim 1, wherein a top end of the protrusion part is formed in a partially spherical shape.

5. The washing machine according to claim 2, wherein a top end of the protrusion part is formed in a partially spherical shape.

6. The washing machine according to claim 3, wherein a top end of the protrusion part is formed in a partially spherical shape.

* * * * *